US007544063B2

(12) United States Patent
Puskar et al.

(10) Patent No.: US 7,544,063 B2
(45) Date of Patent: Jun. 9, 2009

(54) ROTATING DISPLAY DEVICE HAVING WIRING HARNESS RETENTION MEMBER

(75) Inventors: Michael Paul Puskar, Carnegie Borough, PA (US); William Michael Randal, Baldwin Township, PA (US); Thomas Alan Whitaker, North Huntingdon, PA (US)

(73) Assignee: Eaton Corporation, Cleveland, OH (US)

( * ) Notice: Subject to any disclaimer, the term of this patent is extended or adjusted under 35 U.S.C. 154(b) by 479 days.

(21) Appl. No.: 11/430,456

(22) Filed: May 9, 2006

(65) Prior Publication Data

US 2008/0047179 A1 Feb. 28, 2008

(51) Int. Cl.
*H01R 39/00* (2006.01)

(52) U.S. Cl. ..... 439/13; 439/164

(58) Field of Classification Search ..... 439/164, 439/11, 13, 18–28

See application file for complete search history.

(56) References Cited

U.S. PATENT DOCUMENTS

| | | | | |
|---|---|---|---|---|
| 4,513,246 | A | 4/1985 | Blain | |
| 4,675,598 | A | 6/1987 | Boichot-Castagne | |
| 4,731,030 | A * | 3/1988 | Johnston | 439/6 |
| 6,471,529 | B2 | 10/2002 | Oishi | |
| 6,488,510 | B2 | 12/2002 | Li | |
| 6,801,426 | B2 | 10/2004 | Ichimura | |
| 2004/0192073 | A1 | 9/2004 | Ho et al. | |
| 2005/0258921 | A1 | 11/2005 | Puskar et al. | |

* cited by examiner

*Primary Examiner*—Tho D Ta
*Assistant Examiner*—Travis Chambers
(74) *Attorney, Agent, or Firm*—Martin J. Moran

(57) ABSTRACT

A rotating display device enables a user to view, in a variety of viewing orientations, a value of an electrical apparatus to which the rotating display device is electrically and mechanically connected. The rotating display device includes a housing having a first half and a second half, a display for displaying the value, a rotating member disposed within the second half, a retention member slideably received into the rotating member, and a wiring harness secured to the rotating member by the retention member.

9 Claims, 6 Drawing Sheets

ROTATING DISPLAY DEVICE HAVING WIRING HARNESS RETENTION MEMBER

BACKGROUND OF THE INVENTION

1. Field of the Invention

The invention relates generally to an electrical apparatus and, more particularly, to a display device for receiving and displaying a value from an electrical apparatus. The invention also relates to a retention member that secures a wiring harness that is disposed within a display device.

2. Background Information

Displaying operating parameters (e.g., without limitation, voltage; electrical current; frequency) provides one way for a user to ensure that an electrical apparatus is operating properly. Accordingly, electrical apparatus including, for example, electrical switching apparatus, such as circuit switching devices and circuit interrupters (e.g. without limitation, circuit breakers, contactors, motor starters, motor controllers and other load controllers), often include a connector for outputting a value. The value outputted on the connector is typically indicative of one or more operating parameters. Circuit breakers, such as the low voltage circuit breaker 2, shown in FIG. 1, exemplify one type of electrical apparatus that may include such a connector 4.

However, electrical apparatus, including circuit breakers, are often mounted or disposed in a wide variety of orientations with the position of the display device display being dictated by such orientation and the corresponding orientation of the connector on the electrical apparatus. The varying orientations of the electrical apparatus make it difficult to read the value displayed on the display when the electrical apparatus is disposed in any orientation other than a vertical one. For example, circuit breakers can often be mounted sideways or in an inverted orientation, thereby requiring the display device's display to be oriented in a corresponding sideways or inverted orientation. This results in the displayed value being displayed in an improper orientation, thereby making it difficult to be accurately read or interpreted by a user.

SUMMARY OF THE INVENTION

These needs and others are met by embodiments of the invention, which provide a rotating display device for viewing a value in a variable viewing orientation.

In accordance with one aspect of the invention, a retention member is for use with a rotating display device. The rotating display device includes a rotating member disposed therein. The rotating member has a first groove and a second groove that are structured to slideably receive the retention member. The retention member includes: a first flange and a second flange, each of the first and second flanges has a first surface and a second surface, the first flange being structured to be slideably received into the first groove and the second flange being structured to be slideably received into the second groove; and a first web and a second web, the first web extends from the first surface of the first flange to the first surface of the second flange, the second web extends from the second surface of the first flange to the second surface of the second flange.

In accordance with another aspect of the invention, a rotating display device includes: a housing having a first half and a second half; a display for displaying the value, the display being disposed within the first half; a rotating member disposed within the second half; a retention member slideably received into the rotating member; and a wiring harness secured to the rotating member by the retention member.

In accordance with another aspect of the invention, an electrical apparatus includes: an enclosure having a surface; a port disposed on the surface of the enclosure, the port being structured to output a value; and a rotating display device coupled to the port. The rotating display device is structured to receive the value and display the value in a variable viewing orientation, the rotating display device includes: a housing having a first half and a second half; a display structured to display the value, the display being disposed within the first half; a rotating member disposed within the second half; a retention member, the retention member is slideably received into the rotating member; and a wiring harness secured to the rotating member by the retention member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
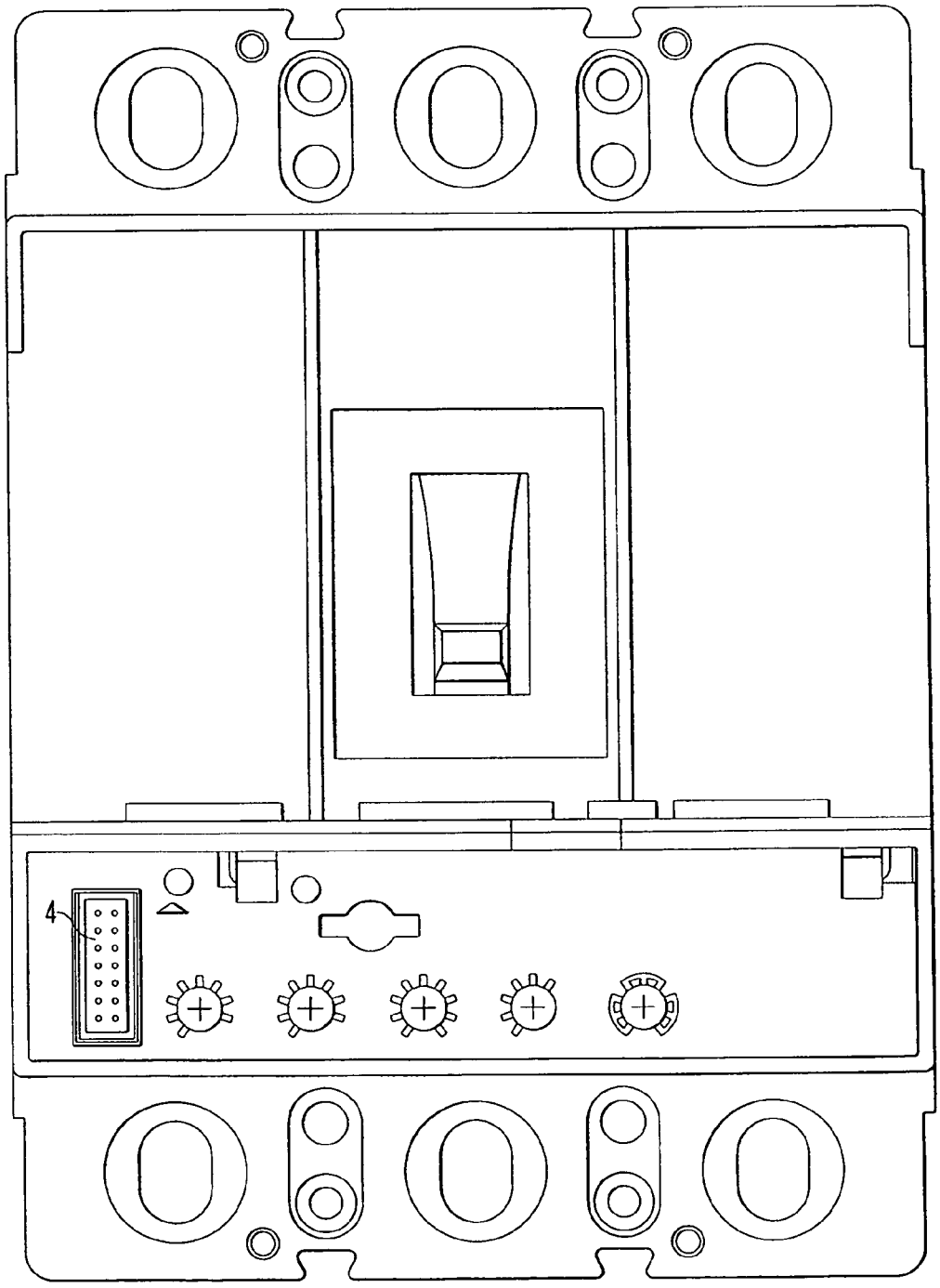
FIG.1 PRIOR ART
FIG. 1 is a top plan view of a low voltage circuit breaker.

The invention is described in association with a display device for a low voltage circuit breaker, although the invention is applicable to a wide range of electrical apparatus, such as, for example, electrical switching apparatus.

Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

As employed herein, the phrase "slideably receives" or variations thereof shall mean that a part is adapted to receive another part which slides into it.

As employed herein, the statement that two or more parts are "coupled" together means that the parts are joined together either directly or joined through one or more intermediate parts.

As employed herein, the term "number" means one or an integer greater than one (i.e., a plurality).

As employed herein, the term "wiring harness" or variations thereof shall mean a number ports or connectors that are electrically connected by a number of conductors.

As employed herein, the term "lip" or variations thereof shall mean a projecting edge.

As employed herein, the term "groove" or variations thereof shall mean a channel or depression.

As employed herein, the term "mechanical fastener" or variations thereof shall refer to any suitable fastening, connecting or tightening mechanism including, but not limited to, screws, bolts, and the combination of bolts and nuts.

As employed herein, the term "variable viewing orientation" shall refer to the ability of the display for a rotating display device to be rotated, for example, to a variety of viewing orientations, in order to permit a user to accurately view and interpret the value displayed thereon even when the connector of the electrical apparatus to which it is coupled is disposed in a different or non-standard orientation.

Figure 2:
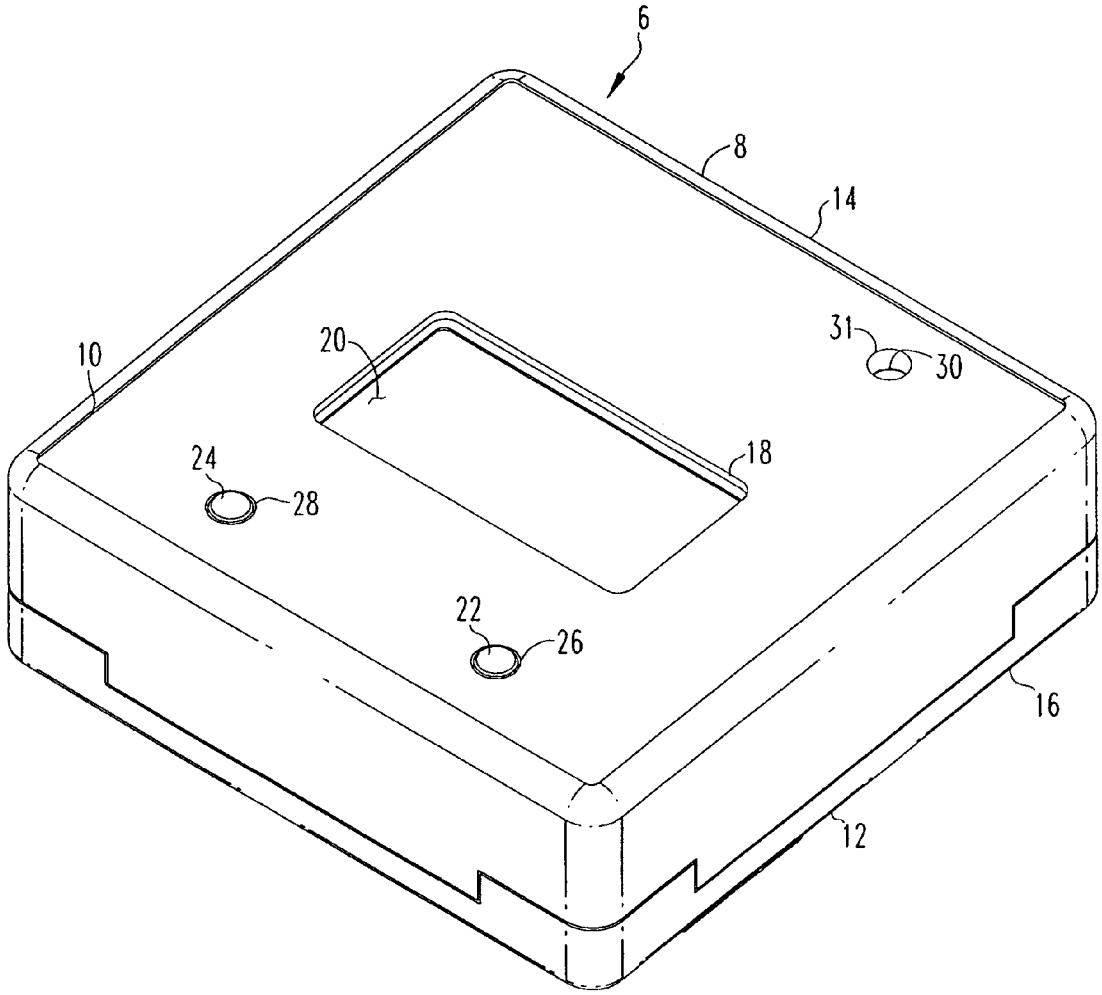
FIG. 2 is an isometric view of a rotating display device including a display in accordance with an embodiment of the invention.

FIG. 2 depicts a rotating display device 6 that receives and displays a value (e.g., without limitation, operational parameter; setpoint; served value) of an electrical apparatus. As will be discussed in further detail below, the rotating display device 6 is mechanically coupled and electrically connected to the electrical apparatus by the connector 4 (FIG. 1) that is located on the electrical apparatus. The rotating display device 6 includes a housing 8 having a first side 10 and a second side 12. The rotating display device 6 further includes a first half 14 and a second half 16. Located on the first side 10 of the housing 8 is a first aperture 18 in which a display 20 is disposed. The display 20 displays (outputs) the value that is received from the electrical apparatus. In one embodiment, the display 20 displays the value in a digital format. However, this is not meant to be limiting since any suitable alternative display format including, but not limited to, an analog display may also be employed.

As can be seen from FIG. 2, the first side 10 of the housing 8 further includes a first control button 22 and a second control button 24. The first control button 22 extends through a second aperture 26 while the second control button 24 extends through a third aperture 28. The control buttons 22,24 are an optional feature designed to permit the user to control the display 20. For example, the control buttons 22,24 may permit the user to switch the value being displayed (e.g. current; voltage) or to change the units in which the value is displayed (e.g., amps; milliamps). The housing 8 may also include a Light Emitting Diode (LED) 30 that indicates, for example, whether the rotating display device 6 is electrically connected to the electrical apparatus. The LED 30 is positioned within a fourth aperture 31 that is located on the first side 10 of the housing 8. The display 20, control buttons 22,24, and LED 30 are disposed and electrically connected to a printed circuit board 32 (shown in FIG. 5) that is located between the first and second housing halves 14,16. As will be discussed in further detail below, the printed circuit board 32 is electrically connected to the electrical apparatus by a wiring harness 34 (shown in FIG. 5) having first and second connectors 36,38 (shown in FIG. 5) that are electrically connected by a number of conductors 40 (shown in FIG. 5). Specifically, the printed circuit board 32 is mechanically coupled and electrically connected to the second connector 38 of the wiring harness 34.

Figure 3:
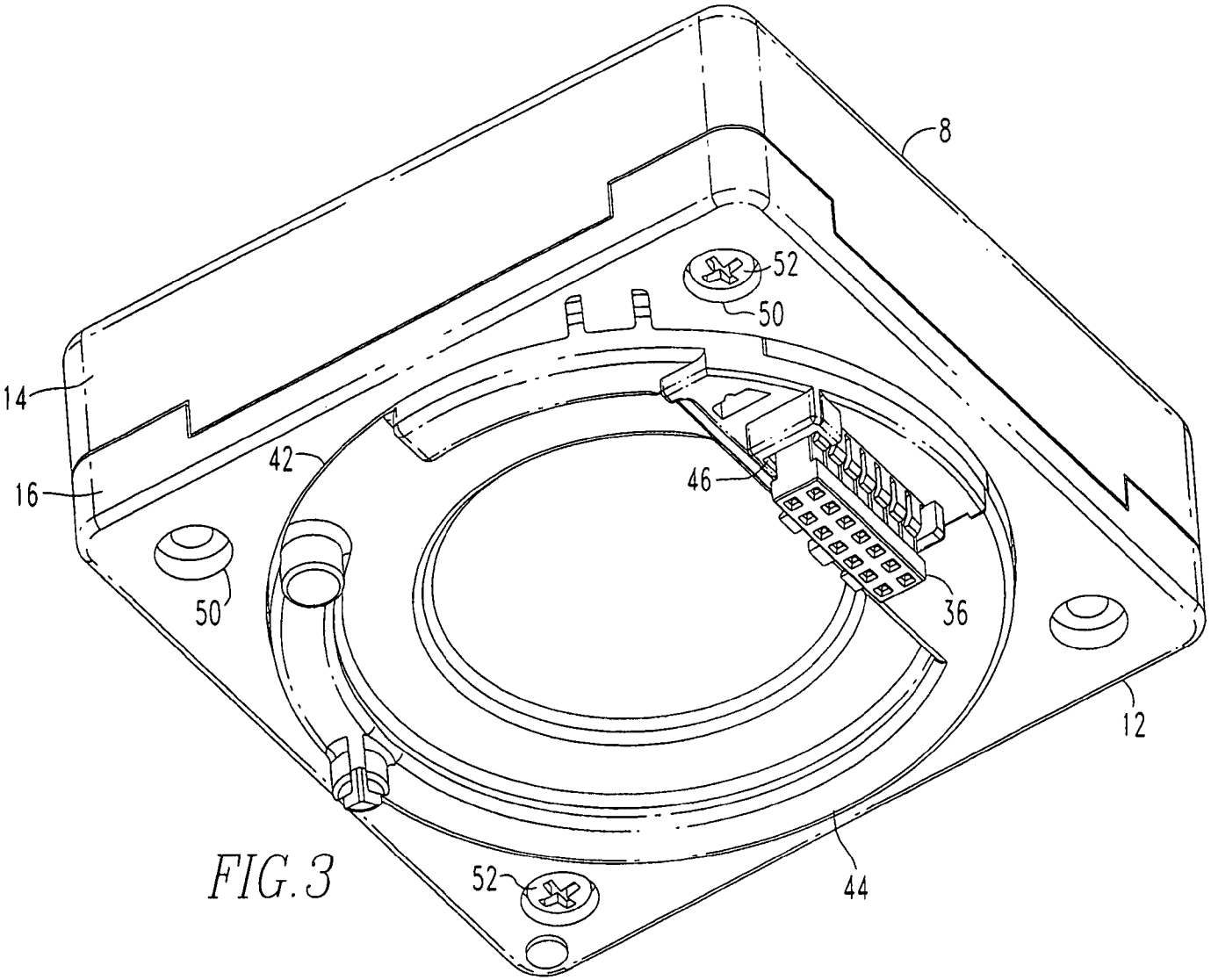
FIG. 3 is an isometric view of the connector side of the rotating display device of FIG. 2.

Referring to FIG. 3, the second side 12 of the housing 8 includes an aperture 42 in which a rotating member 44 is disposed. The rotating member 44 has an aperture 46 that is structured to receive the first connector 36 of the wiring harness 34. As shown, the first connector 36 extends from the second side 12 of the housing 8 when the first connector 36 is positioned within the aperture 46 of the rotating member 44. The first connector 36 is structured to be mechanically coupled and electrically connected to the connector 4 (FIG. 1) that is located on the electrical apparatus thereby electrically connecting the printed circuit board 32 to the electrical apparatus. The second side 12 of the housing 8 further includes a number of apertures 50 that are structured to receive mechanical fasteners 52 which secure the second housing half 16 to the first housing half 14.

Figure 4A:
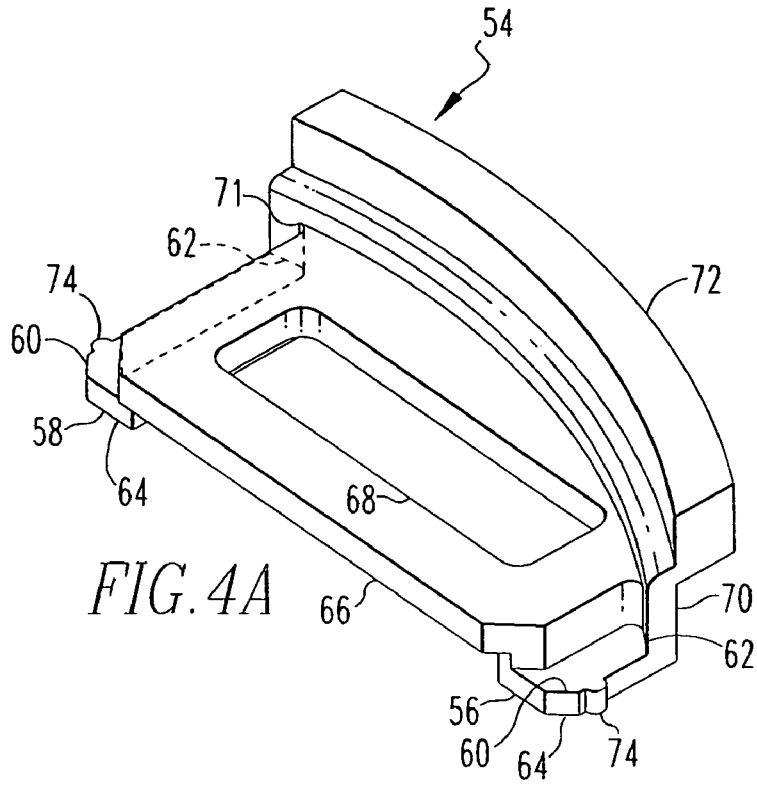
FIGS. 4A and 4B are isometric views of one embodiment of the retention member of FIG. 3.
Figure 4B:
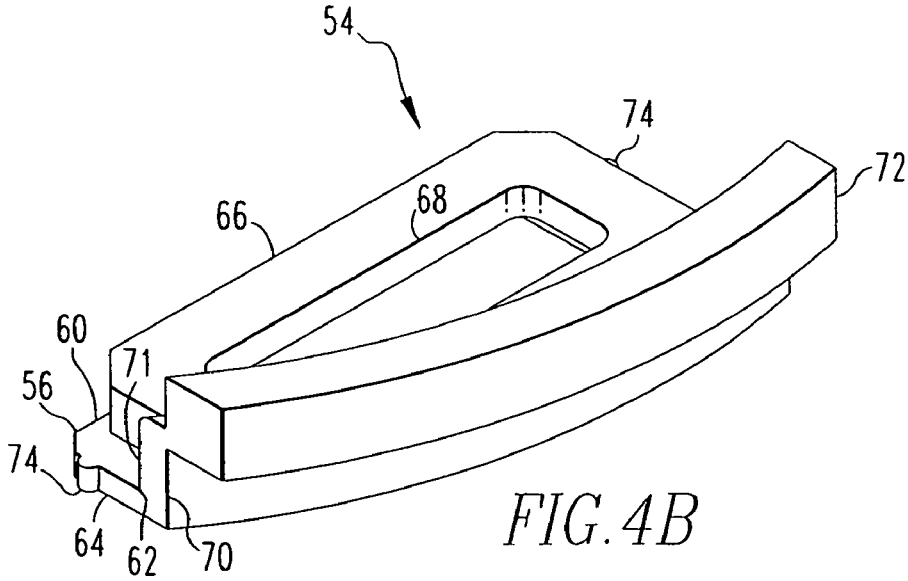
Figure 5:
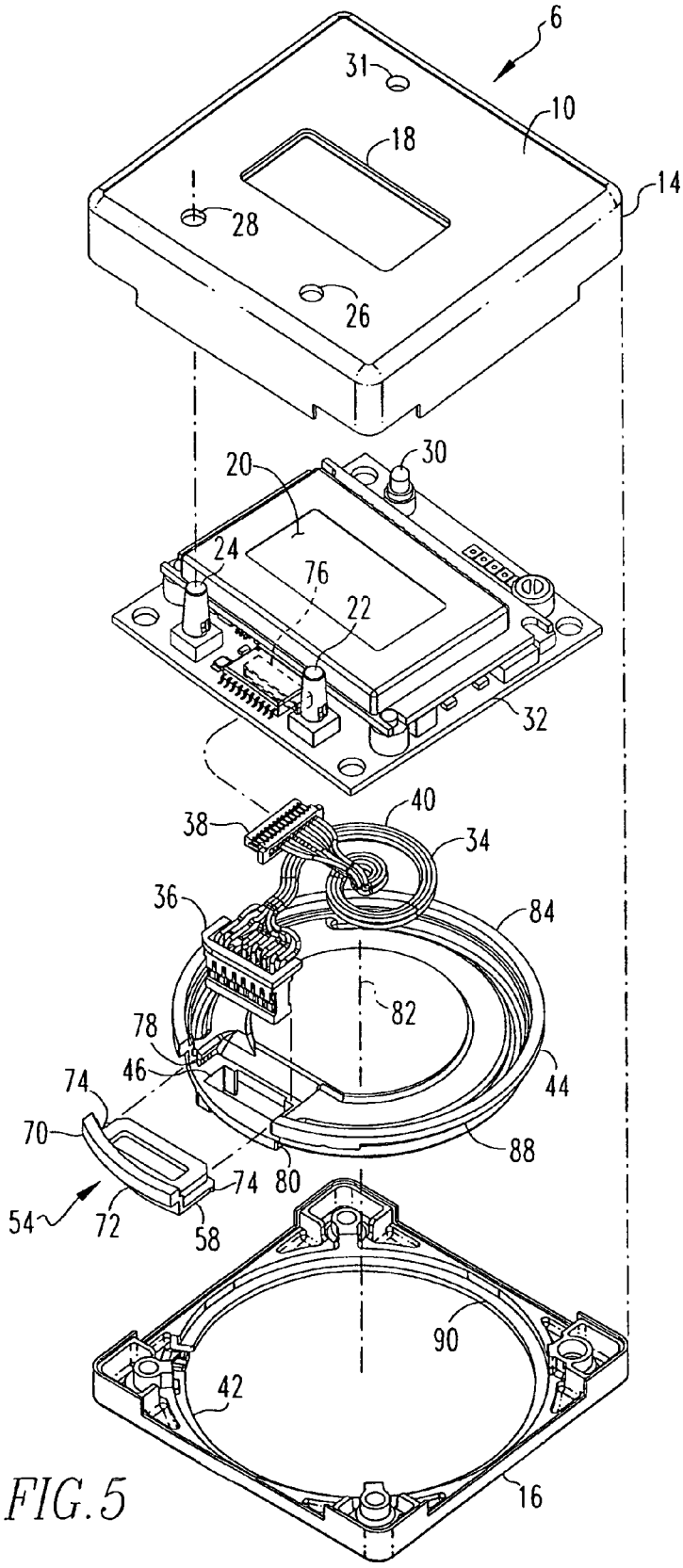
FIG. 5 is an exploded isometric view of the rotating display device of FIG. 2.

Referring to FIG. 5, in order to ensure that the conductors 40 of the wiring harness 34 do not interfere with the various internal components of the rotating display device 6 and that the first connector 36 does not dislodged from the rotating member 44 when the rotating display device 6 is coupled to the electrical apparatus, a retention member 54 (see FIGS. 4A, 4B, 5, and 6) is structured to be slideably received into the rotating member 44. The retention member 54 not only acts as a strain relief and a guide for the conductors 40 of the wiring harness 34, but also secures the first connector 36 to the rotating member 44.

As can be seen from FIGS. 4A and 4B, the retention member 54 includes a first flange 56 and a second flange 58. Each of the first and second flanges 56,58 has corresponding first, second, and third surfaces 60,62,64, as best shown with the first flange 56. Extending from the first surface 60 of the first flange 56 to the first surface 60 of the second flange is a first web 66. The first web 66 includes an aperture 68 that is located, for example, at about the center of the first web 66. Extending from the second surface 62 of the first flange 56 to the second surface 62 of the second flange 58 is a second web 70. The first web 66 is connected to the second web's inner surface 71. In the example embodiment depicted in FIGS. 4A and 4B, the second web 70 is substantially arcuate in shape and includes a substantially arcuate lip 72. The first web 66 extends from the first flange 56 to the second flange 58 in a direction substantially perpendicular to an axis 82 (FIG. 5) of the rotating member 44 (see FIG. 5). Each of the first and second flanges 56,58 also includes a protrusion 74 extending therefrom. It should be noted, however, that despite FIGS. 4A and 4B showing only one protrusion 74 extending from each of the first and second flanges 56,58, a first and second flange 56,58 having two or more protrusions 74 extending therefrom falls within the scope of this invention. The protrusions 74 are structured to securely couple the retention member 54 to the rotating member 44 when the retention member 54 is slideably received into the rotating member 44.

As can be seen from FIG. 5, the printed circuit board 32, the wiring harness 34, and the rotating member 44 are all disposed between the first and second halves 14,16 of the housing 8. The display 20 is inserted through the first aperture 18 that is located on the first side 10 of the housing 8 while the first control button 22 and the second control button 24 as well as the LED 30 are inserted through the respective second, third, and fourth apertures 26,28,31, which are also located on the first housing side 10. As employed, the circuitry (not shown) of the printed circuit board 32 receives the value from a connector 76 that is located on the surface of the printed circuit board 32 that is adjacent to the rotating member 44. The connector 76 is mechanically coupled and electrically connected to the second connector 38 of the wiring harness 34 which, as stated above, is electrically connected to the first connector 36.

Continuing to refer to FIG. 5, the first connector 36 of the wiring harness 34 is structured to be received into the aperture 46 that is located on the rotating member 44. When positioned within the aperture 46 of the rotating member 44, the first connector 36 of the wiring harness 34 is secured to the rotating member 44 by the retention member 54 that is slideably received into the rotating member 44. Specifically, the first and second flanges 56,58 of the retention member 54 are structured to be slideably received into a first groove 78 and a second groove 80 that are located on the rotating member 44, respectively. The first and second grooves 78,80 extend in a direction substantially perpendicular to an axis 82 of the rotating member 44. As stated above, each of the first and second flanges 56,58 of the retention member 54 includes a number of protrusions 74 that secure the retention member 54 to the rotating member 44. The combination of the rotating member 44, the retention member 54 and the first connector 36 of the wiring harness 34, is received into the aperture 42 that is located on the second half 16 of the housing 8. The second housing half 16 is secured to the first housing half 14 by a number of mechanical fasteners 52 (see FIG. 3) that are inserted through the apertures 50 that are located on the second side 12 of the housing 8. As can be seen from FIG. 5, the printed circuit board 32 is secured between the first and second housing halves 14,16 by the mechanical fasteners 52 (FIG. 3). By securing the printed circuit board 32 to the first and second housing halves 14,16, the display 20 rotates with the housing 8 thereby permitting a user to view the display 20 in a variety of viewing orientations.

Figure 6:
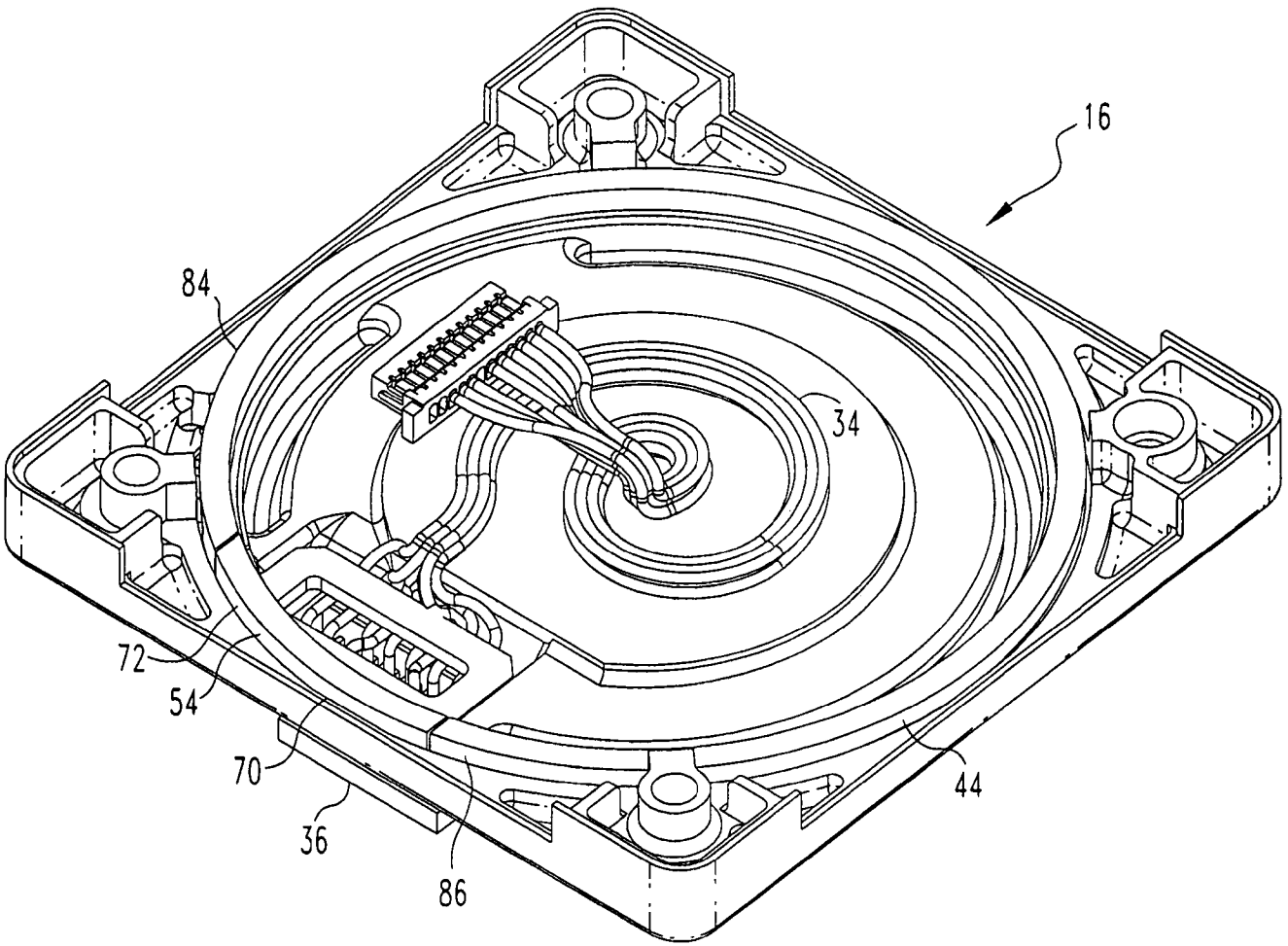
FIG. 6 is an isometric view of the second half of the rotating display device of FIG. 2.

FIG. 6 shows the second housing half 16 having disposed therein the rotating member 44. As can be seen, the rotating member 44 includes the first connector 36 of the wiring harness 34 which is secured to the rotating member 44 by the retention member 54. The rotating member 44 has a lip 84 (as best shown in FIG. 5) that extends along a portion of the perimeter of the rotating member 44. When the retention member 54 is secured to the rotating member 44, the lip 72 of the second web 70 of the retention member 54 in addition to the lip 84 of the rotating member 44 form a complete lip 86 that extends along substantially the entire perimeter of the rotating member 44. The complete lip 86 has a first surface 88 (see FIG. 5) that is positioned adjacent to an edge 90 (see FIG. 5) of the rotating member 44 which secures the rotating member 44 to the second housing half 16 when the second housing half and the printed circuit board 32 are secured to the first housing half 14.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A rotating display device for displaying a value in a variable viewing orientation, said rotating display device comprising:

a housing having a first half and a second half;

a display for displaying said value, said display being disposed within said first half;

a rotating member disposed within said second half;

a retention member slideably received into said rotating member;

a wiring harness secured to said rotating member by said retention member;

wherein said wiring harness comprises a first connector and a second connector that are electrically connected by a number of conductors; and wherein said rotating member comprises a first groove and a second groove; and wherein said retention member comprises a first flange and a second flange, each of said first and second flanges has a first surface and a second surface, said first flange being slideably received into said first groove and said second flange being slideably received into said second groove, and a first web and a second web, said first web extends from said first surface of said first flange to said first surface of said second flange, said second web extends from said second surface of said first flange to said second surface of said second flange.

2. The rotating display device according to claim 1, wherein each of said first and second flanges has a number of protrusions extending therefrom, said protrusions securing said retention member to said rotating member.

3. The rotating display device according to claim 1, wherein said rotating member has an axis; and wherein said first web extends from said first flange to said second flange in a direction substantially perpendicular to said axis of said rotating member.

4. The rotating display device according to claim 1, wherein said rotating member has an aperture that receives said first connector of said wiring harness.

5. The rotating display device according to claim 4, wherein each of said first and second flanges has a third surface; and wherein said first connector of said wiring harness is positioned within said aperture and substantially adjacent to said third surface of each of said first and second flanges.

6. An electrical apparatus comprising:

an enclosure including a surface;

a port disposed on said surface of said enclosure, said port being structured to output a value;

a rotating display device coupled to said port, said rotating display device structured to receive said value and display said value in a variable viewing orientation, said rotating display device comprising:

a housing having a first half and a second half;

a display structured to display said value, said display being disposed within said first. half;

a rotating member disposed within said second half;

a retention member, said retention member is slideably received into said rotating member;

a wiring harness secured to said rotating member by said retention member;

wherein said wiring harness comprises a first connector and a second connector that are electrically connected by a number of conductors; and wherein said rotating member further comprises a first groove and a second groove;

and wherein said retention member comprises a first flange and a second flange, each of said first and second flanges has a first surface and a second surface, said first flange slideably received into said first groove and said second flange slideably received into said second groove, and a first web and a second web, said first web extends from said first surface of said first flange to said first surface of said second flange, said second web extends from said second surface of said first flange to said second surface of said second flange.

7. The electrical apparatus according to claim 6, wherein each of said first and second flanges has a number of protrusions extending therefrom, said protrusions securing said retention member to said rotating member.

8. The electrical apparatus according to claim 6, wherein said rotating member has an aperture that receives said first connector of said wiring harness.

9. The electrical apparatus according to claim 8, wherein each of said first and second flanges has a third surface; and wherein said first connector of said wiring harness is positioned within said aperture and substantially adjacent to said third surface of each of said first and second flanges.

* * * * *